US011850474B2

(12) United States Patent
Greenhalgh

(10) Patent No.: US 11,850,474 B2
(45) Date of Patent: Dec. 26, 2023

(54) FIXED ANCHOR APPARATUSES AND METHODS

(71) Applicant: Scott Greenhalgh, Logan, UT (US)

(72) Inventor: Scott Greenhalgh, Logan, UT (US)

(73) Assignee: Utah State University, Logan, UT (US)

( * ) Notice: Subject to any disclaimer, the term of this patent is extended or adjusted under 35 U.S.C. 154(b) by 0 days.

(21) Appl. No.: 17/508,416

(22) Filed: Oct. 22, 2021

(65) Prior Publication Data

US 2022/0126171 A1 Apr. 28, 2022

Related U.S. Application Data

(60) Provisional application No. 63/104,182, filed on Oct. 22, 2020.

(51) Int. Cl.
*A63B 29/02* (2006.01)

(52) U.S. Cl.
CPC ..... *A63B 29/02* (2013.01)

(58) Field of Classification Search
CPC ..... A63B 29/02; A63B 2209/00
See application file for complete search history.

(56) References Cited

U.S. PATENT DOCUMENTS 2,946,619 A * 7/1960 Wahl ..... F16G 11/046 403/209
5,785,146 A * 7/1998 Palmer ..... A62B 35/0075 294/74
5,873,613 A * 2/1999 Bliehall ..... A63B 29/02 294/219
7,036,780 B1 * 5/2006 Geninatti ..... A63B 29/02 114/230.1
8,061,480 B2 * 11/2011 Grilliot ..... A62B 5/00 119/770
9,468,809 B2 * 10/2016 Coursimault ..... F16B 45/02
11,000,110 B2 * 5/2021 Conlin ..... D03D 11/02
2007/0114095 A1 * 5/2007 Swierski ..... A62B 35/0075 182/9
2016/0107005 A1 * 4/2016 Rogelja ..... A62B 35/0043 182/5
2017/0291048 A1 * 10/2017 Hole ..... B66C 1/14
2018/0001144 A1 * 1/2018 Phillips ..... A63B 29/02
2019/0381359 A1 * 12/2019 Polig ..... A63B 29/02

OTHER PUBLICATIONS

Metolius, Equalizer, Accessed Nov. 8, 2021, https://www.metoliusclimbing.com/equalizers.html.
Metolius, Anchor Chain, Accessed Nov. 8, 2021, https://www.metoliusclimbing.com/anchor-chain.html.

(Continued)

*Primary Examiner* — David M Upchurch
(74) *Attorney, Agent, or Firm* — Thorpe North & Western, LLP.

(57) ABSTRACT

A quad anchor can have a first attachment loop and a second attachment loop. Each of the first and second attachment loops are operable to connect to an anchor point. The quad anchor can also include an intermediate loop disposed between the first attachment loop and the second attachment loop and joined to the first attachment loop and the second attachment loop. The intermediate loop is operable to connect to a load to be supported by the quad anchor.

14 Claims, 6 Drawing Sheets

(56) References Cited

OTHER PUBLICATIONS

Edelrid GmbH & Co., Adjustable Belay Station Sling, Accessed Nov. 8, 2021, https://www.edelrid.de/en/sports/belay-station-slings/adjustable-belay-station-sling.html.
Edelrid GmbH & Co., Belay Station Sling Tech Web, Accessed Nov. 8, 2021, https://www.edelrid.de/en/sports/belay-station-slings/belay-station-sling-tech-web-12mm.html.
Mountain Tools, Webolette, Accessed Nov. 8, 2021, https://www.mtntools.com/cat/mt/web/mt_webolette.htm.

* cited by examiner

FIXED ANCHOR APPARATUSES AND METHODS

CROSS REFERENCE TO RELATED APPLICATION

This application claims priority to U.S. Provisional Application No. 63/104,182 which was filed on Oct. 22, 2020, the contents of which are hereby incorporated by reference.

BACKGROUND

As a result of technological advancements in climbing gear, the rate of accidents related to gear failure has declined. However, accidents attributed to human error have persisted.

In rock and ice climbing, hand-tied "quad anchors" are increasingly being used to mitigate the risk of a fall. These types of anchors typically include four strands of rope or cordelette that run through the center of the system. Using this design, the load is distributed equally between two anchor pieces that attach the quad anchor to the rock. This puts less force on each piece, thereby decreasing the probability of anchor point failure. Quad anchors also provide two independent attachment points for the belayer and the climber, preventing carabiners from getting jammed at the same connection point. Such systems can be entirely redundant, meaning that in the event of failure of a single element of the system, at least one similar element remains intact.

Climbers who wish to use the quad anchor system generally carry either at least fourteen feet of cordelette or a quadruple-length sling with them while climbing, either constructing the quad anchor on site or using a previously constructed quad anchor. The result is considerable bulk that must be carried, the possibility of user error while constructing the quad anchor, and wear points in permanently tied knots. The recommended knots for creating a quad anchor system can be incorrectly tied, and the error may go unnoticed by the climber. For convenience, many climbers leave the knots of their quad anchors permanently in place to enable transportation without re-assembly; this common practice creates wear points in the system that can lead to failure, and it does not substantially improve the system's portability. Climbers who carry a permanently tied system with them as well as those who carry the necessary materials to construct the system during the climb are forced to carry bulky devices. Additionally, tying and un-tying the knots before and after each use erodes the cordelette or sling over time.

SUMMARY

The present disclosure relates to systems and devices for bearing and distributing weight and methods of constructing such systems and devices. Particularly, this disclosure relates to systems and devices for anchoring a climber to a climbing surface and methods of constructing such systems and devices.

The present disclosure includes a quad anchor system and apparatus that reduces the potential for human error and improves portability and convenience. It is a permanent system, rather than one that is tied and un-tied by the user, which eliminates at least one potential source of error, while reducing bulk. The system and apparatus can allow use of a broad range of materials, including ultra-high molecular weight polyethylene.

The particular configuration of the quad anchor of the present disclosure reduces another potential source of user error by clarifying the points at which the device can be clipped to anchor points and loads, which may not be accurately identified in prior art systems. It also clarifies which two strands should be clipped into, further reducing potential user error. The two loops are aligned to avoid the differences in length inherent in a system with loops that run entirely within one another, such as the traditional quad. This reduces the potential for an "American Death Triangle", a configuration that can result from rope failure or from user error in knot tying that magnifies the load forces on the fixed anchors and reduces the redundancy of the system.

In one example of the present disclosure, a quad anchor can comprise a first attachment loop and a second attachment loop. Each of the first attachment loop and the second attachment loop can be operable to connect to an anchor point. The quad anchor can further comprise an intermediate loop disposed between the first attachment loop and the second attachment loop and joined to the first attachment loop and the second attachment loop. The intermediate loop can be operable to connect to a load to be supported by the quad anchor.

In some examples, the first attachment loop, the second attachment loop, and the intermediate loop are formed from a first loop of flexible material. Portions of the first loop of flexible material can be joined together at a first pinch point to form the first attachment loop. Portions of the first loop of flexible material can also be joined together at a second pinch point to form the second attachment loop. The intermediate loop can be formed between the first pinch point and the second pinch point.

In some examples, the quad anchor can comprise a second loop of flexible material. The second loop of flexible material can encircle the first loop of flexible material, where the second loop of flexible material can define an outer loop and the first loop of flexible material can define an inner loop. The outer loop can be joined to the inner loop at a first connection point disposed at the first attachment loop and at a second connection point disposed at the second attachment loop.

In some examples, the outer loop can be joined to the inner loop at a plurality of third connection points disposed between the first pinch point and the second pinch point. The first loop can be sewn to the second loop at at least one of the plurality of third connection points. The first connection point can be located at a first end of the quad anchor and the second connection point can be located at a second end of the quad anchor. The first loop and the second loop can comprise at least one of the following materials: nylon; polyethylene; polyester; acrylic; aramid; or ultra-high molecular weight polyethylene.

In some examples, the first loop and the second loop are each 60 to 120 cm in length. In some examples, the first loop comprises a different elasticity than the second loop.

In some examples, at least one of the first pinch point and the second pinch point can be sewn. The first pinch point can be located 1-6 inches away from a first end of the first loop and the second pinch point can be located 1-6 inches away from a second end of the first loop, and in some cases each pinch point can be located 3-6 inches away.

In another example of the present disclosure, a method of constructing a quad anchor is provided. The method can include connecting a first loop to a second loop at a first connection point and a second connection point; pinching and joining portions of the first loop at a first pinch point near a first end of the first loop to form a first attachment loop; and pinching and joining portions of the first loop at a second pinch point near a second end of the first loop to form a second attachment loop.

In some examples, the method can further comprise connecting the first loop to the second loop at a plurality of third connection points between the first pinch point and the second pinch point.

In some examples, the method can comprise attaching a first spring hook the first attachment loop and attaching a second spring hook to the second attachment loop. A third spring hook can be attached to the first and second loops between the first pinch point and the second pinch point, and one or more ropes can be attached to the third spring hook. The first and second spring hooks can be configured to attach the quad anchor to one or more anchor points attached to a climbing surface. The first loop and the second loop can also be twisted to form a lemniscate shape.

In another example of the present disclosure, a quad anchor can comprise a first loop of flexible material, a first attachment loop joined to the first loop of flexible material at a first end of the first loop of flexible material, and a second attachment loop joined to the first loop of flexible material at a second end of the first loop of flexible material.

In some examples, the quad anchor can comprise a second loop of flexible material. The second loop of flexible material can be connected to the first loop of flexible material and the first attachment loop at the first end. The second loop of flexible material can also be connected to the first loop of flexible material and the second attachment loop at the second end.

A first spring hook can be operable to attach the first attachment loop to a first anchor point. A second spring hook can be operable to attach the second attachment loop to a second anchor point. A third spring hook can be operable to attach to the first loop of flexible material between the first attachment loop and the second attachment loop to attach a load to the quad anchor.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EMBODIMENTS

For purposes of the present disclosure, the term "loop" is used to describe any apparatus forming a closed shape. For example, a "loop," as referenced in the present disclosure, can be a circular portion of flexible material where one end of the flexible material is connected to the other end of the material to form a closed shape. As another example, a "loop" can be two or more flexible pieces of material joined together at ends to form a closed shape. As another example, a "loop" can be a closed shape formed by connecting any point or points along one or more pieces of flexible material to form a closed shape with at least a portion of the one or more pieces of flexible material.

For the purposes of the present disclosure, the term "anchor" can be used to describe any system or device configured to attach a climber, rope, or load to a climbing surface. The term "anchor point" can be used to describe an attachment point or attachment feature that is disposed on a point or location on the climbing surface itself to which an anchor can attach or from which an anchor can be built. An anchor can comprise or can be attached to multiple anchor points. "Quad anchor" means an anchor configured to be attached to the climbing surface through at least two anchor points and including four strands tied or sewn together.

In this specification and the claims that follow, singular forms such as "a," "an," and "the" include plural forms unless the content clearly dictates otherwise. All ranges disclosed herein include, unless specifically indicated, all endpoints and intermediate values. In addition, "optional" or "optionally" or "or" refer, for example, to instances in which subsequently described circumstance may or may not occur, and include instances in which the circumstance occurs and instances in which the circumstance does not occur. The terms "one or more" and "at least one" refer, for example, to instances in which one of the subsequently described circumstances occurs, and to instances in which more than one of the subsequently described circumstances occurs.

Figure 1A:
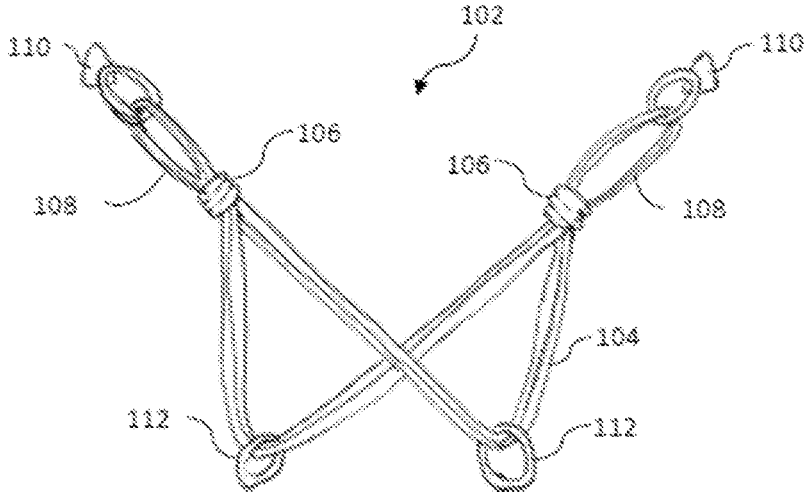
FIG. 1A (PRIOR ART)
FIGS. 1A-B illustrate a quad anchor apparatus in accordance with one or more embodiments of the prior art.

FIG. 1A illustrates a quad anchor apparatus 102 in accordance with one or more embodiments of the prior art. As illustrated in FIG. 1A, a quad anchor apparatus 102 can include a cordage 104. The cordage 104 can include two hand-tied knots 106 that form two loops 108 spaced apart and which can be attached to two corresponding anchor points 110. For example, loops 108 can be attached to anchor points 110 of a rock surface. Quad anchor apparatus 102 can be mechanically connected to one or more spring hooks 112. This can be done by clipping spring hooks 112 over the cordage 104.

Although not shown in FIG. 1A, a third hand-tied knot can be used to connect two ends of the cordage 104 to form a continuous quad anchor apparatus 102. As discussed above, quad anchor apparatus 102 may be unreliable, since the knots 106 can erode over time, causing cordage 104 to break or fray at the knots 106.

Figure 1B:
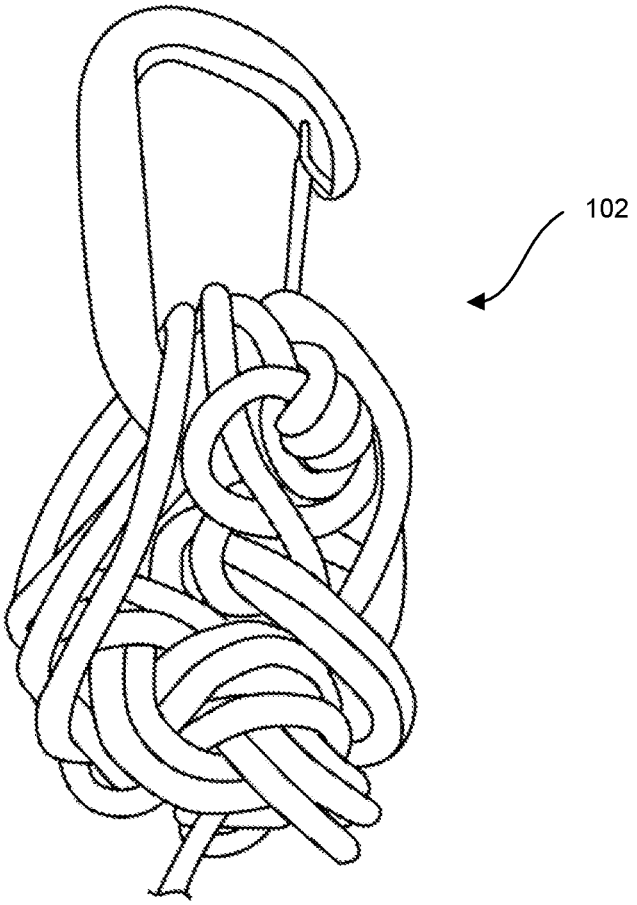
FIG. 1B (PRIOR ART)

FIG. 1B is a view of a stored version of the quad anchor apparatus 102. As shown in FIG. 1B, the quad anchor apparatus 102 can be stored by unclipping the apparatus 102 from anchor points 110 and leaving knots intact. As discussed above, this can cause the cordage 104 to break or erode over time. As shown in FIG. 1B, the stored version of quad anchor apparatus 102 can be relatively bulky, especially in comparison to the stored version of a quad anchor 200 described in connection with FIGS. 2A-6.

FIGS. 2A-2D illustrate a quad anchor apparatus in accordance with an example of the present disclosure.

Figure 2A:
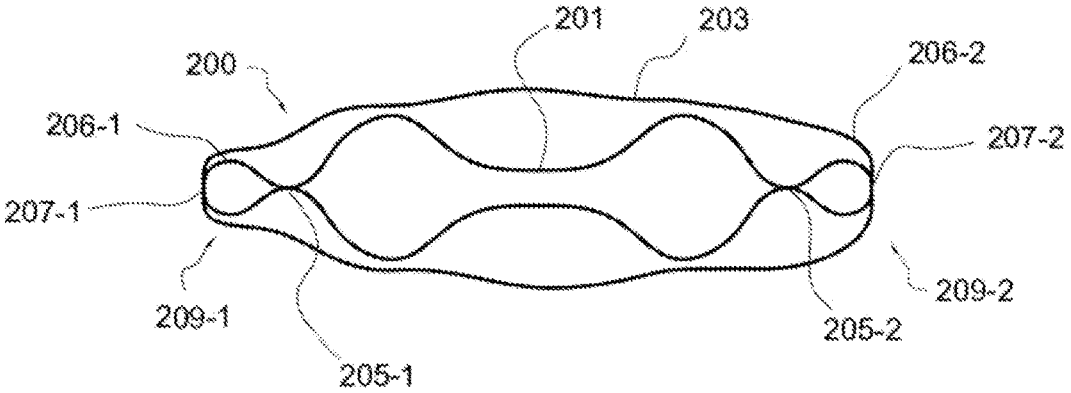
FIGS. 2A-D illustrate a quad anchor apparatus in accordance with one or more embodiments of the present disclosure.

As illustrated in FIG. 2A, a quad anchor 200 can include two loops of material 201 and 203. Each of the loops 201, 203 can be formed of a flexible piece of material that is connected to itself at each end. Typically the loops are continuous loops (i.e. not tied together). Rather, the loops can be woven continuously in most cases (i.e. no discrete knot tying ends together). As shown in FIG. 2A, a first loop 201 can be of a shorter length than a second loop 203, although in some cases the first loop 201 can be an equal or longer length than the second loop 203. In such embodiments, the first loop 201 can be positioned within the second loop 203. In other words, the second loop 203 can encircle the first loop 201. However, this is not intended to be limiting in any way. For example, the first loop 201 and the second loop 203 can be of equal length. The loops 201 and 203 can be of any length suitable for constructing a quad anchor. For example, the loops 201 and 203 can range in circumferential length from 50-140 cm, and in some cases 60-120 cm.

The loops 201 and 203 can each comprise any material suitable for weightbearing. For example, the loops 201 and 203 can comprise one or more of the following materials: nylon, polyethylene, polyester, polypropylene, polyethylene terephthalate, acrylic, aramid, combinations thereof, or composites thereof. In some examples, the first loop 201 and/or the second loop 203 can comprise ultra-high molecular weight polyethylene. The loops 201 and 203 can each comprise flexible material so that the apparatus can be easily compressed to a smaller size for transportation. The flexible material can be an elastic band, woven rope, polymer strand, or the like. As a general guideline, the flexible material can be rated at least 12 kN, and in some cases at least 20 kN.

As shown in FIG. 2A, the first loop 201 can be joined to itself or "pinched" at a first pinch point 205-1 near a first end 209-1 of the first loop 201 and at a second pinch point 205-2 near a second end 209-2 of the first loop 201. In other words, two portions of the first loop 201 near the first end 209-1 can be pinched or joined at pinch point 205-1, and two portions of the first loop 201 near the second end 209-2 can be pinched or joined at pinch point 205-2. At least one of the pinch points 205-1 and 205-2 can be joined together by sewing or stitching. For example, at least one of the pinch points 205-1 and 205-2 can be sewn using bar tack stitches. However, this is not intended to limiting. In another example, at least one of the pinch points 205-1, 205-2 can be joined by fabric welding, by a fabric adhesive, or by any other suitable joining method such as via a fastening device.

The pinch points 205-1 and 205-2 can be located at any distance away from the ends 209-1, 209-2 of the first loop. For example, the pinch points 205-1 and 205-2 can be located one to six inches, and in some cases three to six inches, away from each end 209-1, 209-2 of the first loop, respectively. The joining of the portions of the first loop 201 at the pinch points 205-1, 205-2 can form a first attachment loop 206-1 between the first end 209-1 of the inner loop 201 and the first pinch point 205-1 and a second attachment loop 206-2 between the second end 209-2 of the inner loop 201 and the second pinch point 205-2. The attachment loops 206-1, 206-2 can be used to attach the quad anchor 200 to anchor points, as will be discussed in more detail below. The joining of the portions of the first loop 201 and the pinch points 205-1, 205-2 can also form an intermediate loop 208 in the first loop between the pinch points 205-1, 205-2. The intermediate loop can be used to attach the quad anchor 200 to a load, as will be discussed in more detail below. Typically, the first end 209-1 and second end 209-2 can be equally spaced apart along the second loop 203. In one example, the first end and the second end can be offset along the second loop to balance forces on each loop.

As shown in FIG. 2A, the first loop 201 and the second loop 203 can be connected at two points 207-1 and 207-2. For example, the first loop 201 and the second loop 203 can be attached at the first attachment loop 206-1 and at the second attachment loop 206-2. In some embodiments, the first loop 201 can be sewn to the second loop 203 at points 207-1 and 207-2. For example, the first loop 201 can be sewn to the second loop 203 at points 207-1 and 207-2 using bar tack stitches. However, this is not intended to limiting. In another example, the first loop 201 can be joined to the second loop 203 at points 207-1 and 207-2 by fabric welding, by a fabric adhesive, partial melting, or by any other suitable joining method such as via a fastening device.

A first point 207-1 can be located at a first end 209-1 of the quad anchor 200. A second point 207-2 can be located at a second end 209-2 of the quad anchor 200.

Figure 2B:
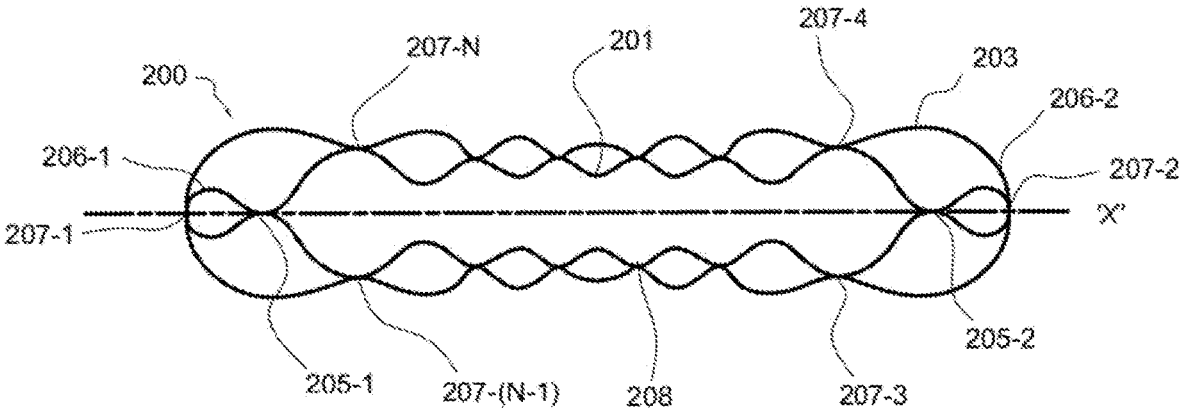

FIG. 2B illustrates another embodiment of a quad anchor apparatus in accordance with the present disclosure. In this example, the quad anchor 200 can have one or more secondary connection points between the first loop 201 and the second loop 203 at a number of points 207-3 . . . 207-N between points 207-1 and 207-2, or at a number of points along the intermediate loop 208. The number of secondary connection points can vary but, when present, generally range from two to ten, and in some cases three to five.

The first loop 201 can be connected to the second loop 203 at a multitude of points 207-1 . . . 207-N. In one example, the number of points 207-N can be sufficiently high to essentially form a continuous lengthwise connection between the two pinch points. In another alternative, the loops can be partially embedded into one another, e.g. placing a portion of the first or second loop within a corresponding portion of the second or first loop. For example, a tubular webbing can be used to form one of the loops and the other loop can be run through that portion of the webbing. As shown in FIG. 2B, one or more of the multitude of points 207-3 . . . 207-N can be positioned between the first pinch point 205-1 and the second pinch point 205-2. Each of the multitude of points 207-3 . . . 207-N can have a corresponding point of the multitude of points 207-3 . . . 207-N. The corresponding point of the multitude of points 207-3 . . . 207-N can be positioned opposite from the given point of the multitude of points 207-3 . . . 207-N. Although FIG. 2B illustrates six total points between the first pinch point 205-1 and the second pinch point 205-2, this is not intended to be limiting. For example, the first loop 201 can be connected to the second loop 203 at more or less than six total points, such as two, four, or eight points between the first pinch point 205-1 and the second pinch point 205-2.

As shown in FIG. 2B, the quad anchor 200 can be approximately symmetrical about an axis X, and in some cases fully symmetrical. For example, the number of points 207-4 . . . 207-N located above the axis X can be equal to the number of points 207-3 . . . 207-(N−1) located below the axis X. Additionally, the distance between a given point of the multitude of points 207-3 . . . 207-N and the axis X can be approximately equal to the distance between a corresponding point of the multitude of points 207-3 . . . 207-N and the axis X. For example, a distance between a given point 207-3 and the axis X can be equal to the distance between a corresponding point 207-4 and the axis X.

Figure 2C:
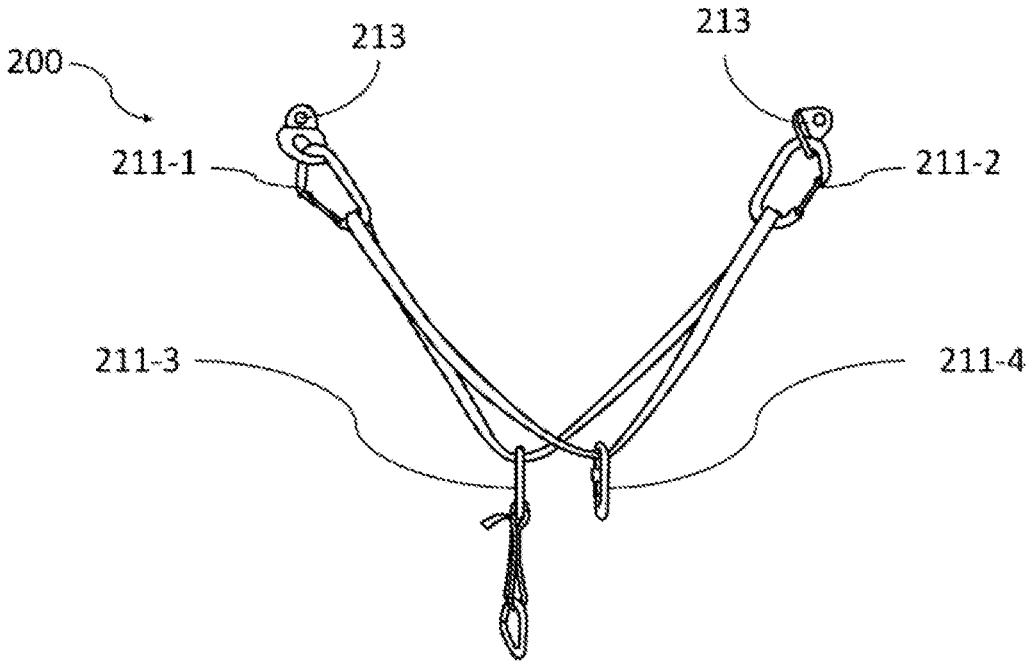

FIG. 2C is another illustration of the embodiment shown in FIG. 2A shown with spring hooks 211-1 . . . 211-4 included. As shown in FIG. 2C, a number of spring hooks 211-1 . . . 211-N can be attached to the quad anchor 200. For example, a first spring hook 211-1 can be attached to the quad anchor 200 at the attachment loop 206-1 between the first point 207-1 and the first pinch point 205-1. A second spring hook 211-2 can be attached to the quad anchor 200 at the attachment loop 206-2 between the second point 207-2 and the second pinch point 205-2. The first spring hook 211-1 and the second spring hook 211-2 can be configured to attach the quad anchor 200 to a number of anchor points 213. Although not shown in FIG. 2C, the anchor points 213 can be attached to or located on a climbing surface. The climbing surface can comprise, for example, rock or ice. However, this is not intended to be limiting. For example, the anchor points can comprise any number of artificial or natural anchor points and the climbing surface can be an artificial surface such as a climbing gym wall.

Additional spring hooks 211-3, 211-4 can also be attached to the quad anchor 200. For example, the spring hook 211-3 can be attached to a first portion of the first and second loops 201, 203 extending between the pinch points 205-1, 205-2 including the intermediate loop 208 (e.g. the portion of loops 201, 203 shown above the axis X and between pinch points 205-1, 205-2 in FIG. 2B). The spring hook 211-4 can be attached to a second portion of the first and second loops 201, 203 extending between the pinch points 205-1, 205-2 including the intermediate loop 208 (e.g. the portion shown below the axis X and between pinch points 205-1, 205-2 in FIG. 2B).

The spring hooks 211-3, 211-4 can connect a climber, a belayer, and/or other load to the quad anchor mechanism 200. For example, although not shown in FIG. 2C, one or more of the spring hooks 211-3 and 211-4 can be attached to one or more ropes. The one or more ropes can be attached to a load to be borne by the quad anchor 200. For example, the one or more ropes can be attached to a climber through a climbing harness.

Figure 2D:
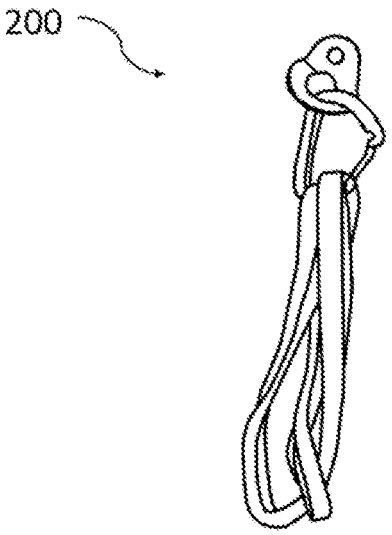

FIG. 2D is a view of a stored version of quad anchor 200. When not in use, quad anchor 200 can be stored in a relatively compact form, especially in comparison to the stored version of the prior art quad anchor apparatus 102 shown in FIG. 1B.

Other variations of the quad anchor 200 can also be formed consistent with these principles. For example, with sufficiently strong material, the quad anchor 200 can be constructing utilizing only the inner loop 201 discussed above. In this example, the quad anchor 200 can comprise the inner loop 201 where the inner loop 200 comprises pinch points 205-1, 205-2 at which portions of the inner loop 201 are joined together to form the attachment loops 206-1, 206-2 and the intermediate loop 208. In use, the spring hooks 211-1, 211-2 can attach to the attachment loops 206-1, 206-2 to connect to anchor points, while the spring hooks 211-3, 211-4 can attach to at least portions of the intermediate loop 208 to connect to a load. In yet another alternative, one or more of the inner loop 201, intermediate loop 208, and attachment loops 206 can be formed of a tubular webbing in which at least a portion of a corresponding loop can be run through an interior of the tubular webbing.

In another example, instead of portions of the inner loop being joined together at pinch points to form the attachment loops at each end and an intermediate loop therebetween, three separate pieces of material can be used. For example, two smaller pieces of materials can be joined together at ends to form the attachment loops. A larger piece of material can be joined together at its ends to form the larger intermediate loop between the attachment loops. The attachment loops can be joined to the larger intermediate loop on each side of the large loop. In use, the spring hooks 211-1, 211-2 can connect to the attachment loops to connect to anchor points, and the spring hooks 211-3, 211-4 can attach to the intermediate loop to connect to a load.

In another example, the inner loop 201 and the outer loop 203 can be formed from materials having different elasticities. For example, one of the inner loop 201 or the outer loop 203 can be formed from a first resilient material that can stretch when acted on by a static and/or a dynamic load and that can return to an original length when the load is removed. The other of the inner loop 201 or the outer loop 203 can be formed from a material that does not stretch, or that is at least less resilient than the first resilient material. In this example, a shorter of the inner loop 201 or the outer loop 203 can comprise the first resilient material, and a longer of the inner loop 201 or the outer loop 203 can comprise the material that does not stretch or the less resilient material. When the quad anchor 200 is acted on by a load, the first resilient material can absorb energy resulting from the load until the length of the shorter loop stretches to the length of the longer loop. When the shorter loop stretches to the length of the longer loop, both loops can then absorb energy resulting from the load applied to the quad anchor 200.

Figure 3:
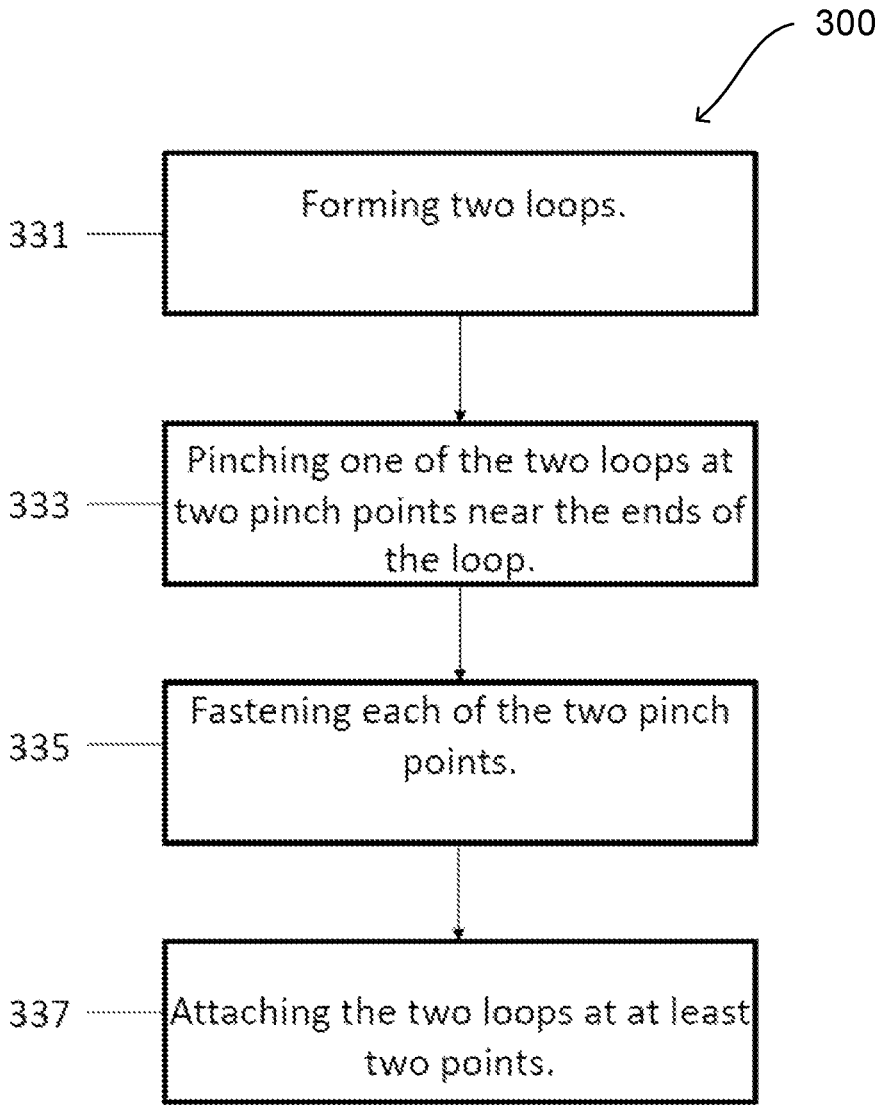
FIG. 3 illustrates a method of constructing a quad anchor apparatus in accordance with one or more embodiments of the present disclosure.

FIG. 3 illustrates a method 300 of constructing a quad anchor apparatus (e.g., quad anchor 200) in accordance with one or more embodiments of the present disclosure. As shown in FIG. 3, the method 300 can include a first step 331 of forming two loops (e.g. loops 201 and 203 described in connection with FIGS. 2A-2D). In this step, two pieces of material can be manufactured and/or cut to a predetermined length. The length and the type of the material for each loop can be the same or can be different. The pieces of material can be formed into individual loops by attaching ends of the pieces of material together, such as by sewing, back-braiding, splicing, or by any other suitable joining method. The materials that can be used for creating the loops are discussed above.

The method 300 can also include a step 333 of pinching portions of one of the two loops (e.g. loop 201) at two pinch points near the ends of the loop and joining the portions of the loop at each of the two pinch points as shown in step 335. For example, the portions of the loop joined at the two pinch points can be sewed or otherwise joined together at each of the two pinch points. In other examples, joining or fastening the loop at each of the two pinch points can be done through one or more fastening devices. A fastening device can include, but is not limited to, a pin, a buckle, or a hook, for example.

The next step 337 can include attaching each of the two loops at at least two points. For example, the two loops can be attached to each other at each end of each loop. In another example, the two loops can also be attached to each other at one or more points between the pinch points. The loops can be joined together at the attachment points by any suitable joining method such as by sewing, fabric welding, or via a fastening device as previously described.

Although not shown in FIG. 3, the method 300 can further include twisting the quad anchor device to form a lemniscate shape. The device can also be attached to one or more anchor points on a climbing surface (e.g. anchor points 213). For example, one or more spring hooks can attach the device to the anchor points. Additional spring hooks can be used to attach the device to a load (e.g., a climber).

Figure 4:
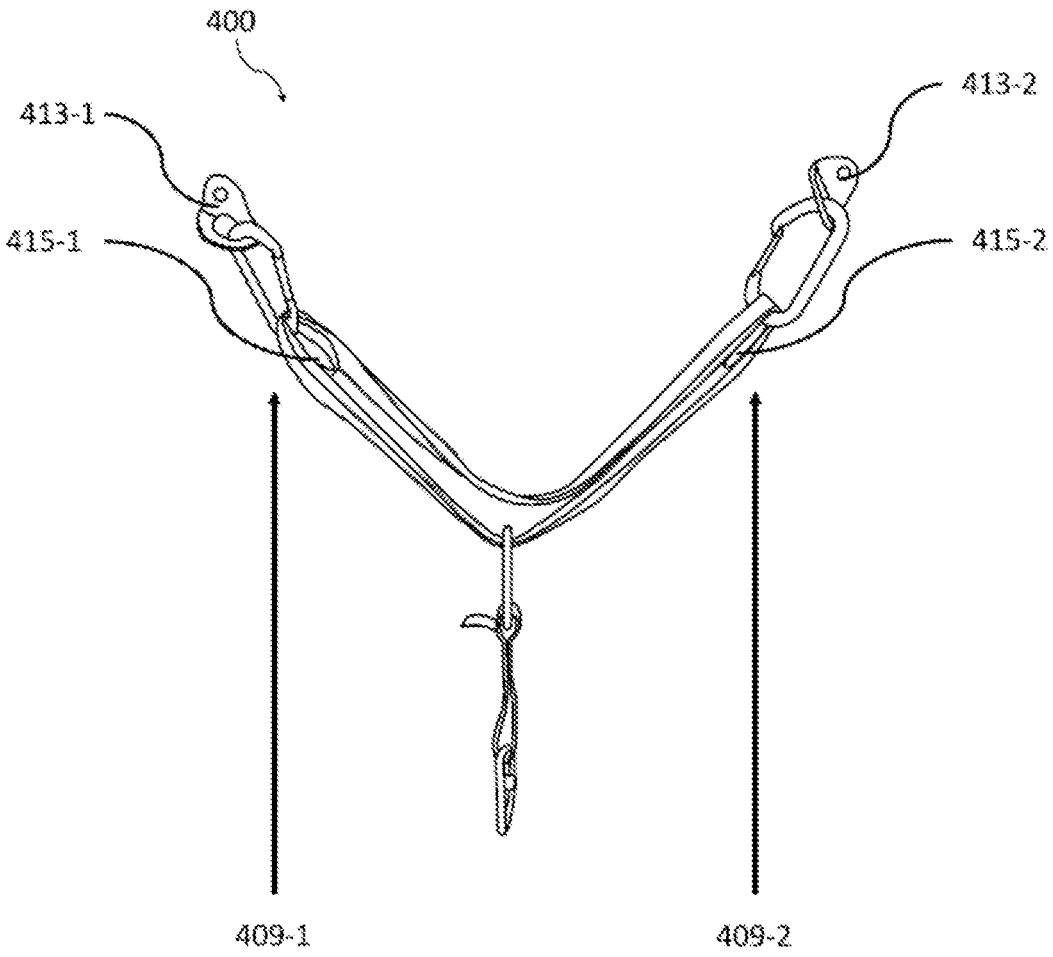
FIG. 4 illustrates another embodiment of a quad anchor apparatus in accordance the present disclosure.

FIG. 4 illustrates another embodiment of a quad anchor apparatus in accordance with one or more embodiments of the present disclosure. As shown in FIG. 4, quad anchor 400 (analogous to quad anchor 200) can include two additional loops 415-1 and 415-2. The two additional loops 415-1 and 415-2 can be located at each end 409-1 and 409-2 of the quad anchor 400 and can each be considered an attachment loop operable to connect the quad anchor 400 to anchor points 413-1, 413-2. The loops 415-1 and 415-2 can be attached to the quad anchor 400, for example, through the use of bar tack stitches, although this is not intended to be limiting. The loops 415-1, 415-2 can be joined to the quad anchors using any suitable joining methods such as those already described herein.

In some examples, the quad anchor 400 can be attached to one or more anchor points 413-1 and 413-2 the two loops 415-1 and 415-2. With the use of the two additional loops 415-1, 415-2, the quad anchor 400 does not need to incorporate pinch points in an inner loop (such as inner loop 201 of quad anchor 200). In other examples, the additional loops 415-1, 415-2 can be attached to a single loop (such as inner loop 201 of quad anchor 200) to form the quad anchor 400 without both an inner loop and an outer loop (such as inner loop 201 and outer loop 203 of quad anchor 200).

Figure 5:
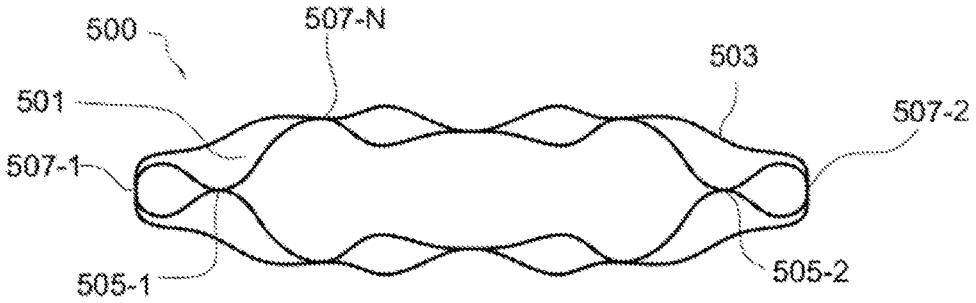
FIG. 5 illustrates another embodiment of a quad anchor apparatus in accordance with the present disclosure.

FIG. 5 illustrates another embodiment of a quad anchor 500 in accordance with one or more embodiments of the present disclosure. As shown in FIG. 5, a quad anchor 500 can include a first loop 501 and a second loop 503, wherein the first loop 501 is pinched or joined at pinch points 505-1 and 505-2. The first loop 501 can be attached to the second loop 503 at a number of points 507-N. First pinch point 505-1 can be located closer to one of the points 507-N than to 507-1 (i.e. relative to a center longitudinal axis). In this example, the quad anchor 500 can have attachment loops that are relatively larger than those shown in FIGS. 2A-2D, and can have an intermediate loop that is relatively smaller than that shown in FIGS. 2A-2D.

Figure 6:
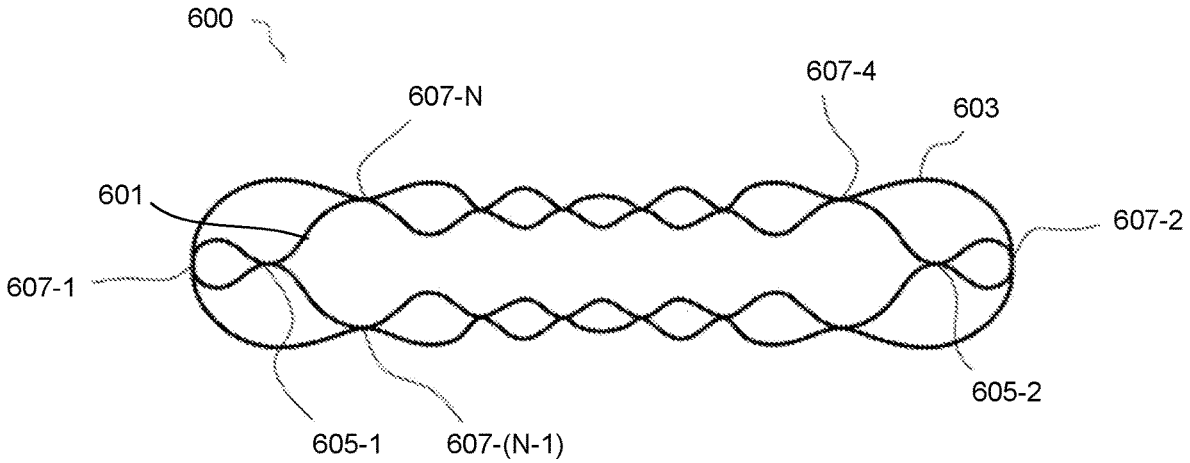
FIG. 6 illustrates another embodiment of a quad anchor apparatus in accordance with the present disclosure.

FIG. 6 illustrates still another embodiment of a quad anchor in accordance with the present disclosure. As shown in FIG. 6, quad anchor 600 can include two loops 601 and 603. The two loops 601 and 603 can be attached at a number of points 607-1 . . . 607-N. For example, FIG. 6 illustrates twelve points 607-N. However, embodiments of the present disclosure are not so limited. Each of the points 607-N can be located between two pinch points 605-1 and 605-2.

In accordance with the present disclosure, the term "spring hook" can include any device with the ability to open and close and including a spring snap to prevent it from accidentally opening while closed. A spring hook can include, for example, a carabiner.

It will be appreciated that several of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

The present invention may be embodied in other specific forms without departing from its spirit or essential characteristics. The described embodiments are to be considered in all respects only as illustrative, and not restrictive. All changes which come within the meaning and range of equivalency of the foregoing description are to be embraced within the scope of the invention. Accordingly, it is not intended that the invention be limited, except as by the claims set forth below.

What is claimed is:

1. A quad anchor, comprising:

a first attachment loop;

a second attachment loop, each of the first attachment loop and the second attachment loop being configured to connect to an anchor point; and an intermediate loop disposed between the first attachment loop and the second attachment loop, the intermediate loop being permanently joined to the first attachment loop and the second attachment loop at a first pinch point and a second pinch point, respectively, and the intermediate loop being configured to connect to a load to be supported by the quad anchor;

wherein the first attachment loop, the second attachment loop, and the intermediate loop are formed from a first, single loop of flexible material, wherein portions of the first loop of flexible material are joined together at the first pinch point to form the first attachment loop and at the second pinch point to form the second attachment loop, the intermediate loop being formed between the first pinch point and the second pinch point;

wherein a second loop of flexible material encircles the first loop of flexible material.

2. The quad anchor of claim 1, wherein the second loop of flexible material defines an outer loop and the first loop of flexible material defines an inner loop, the outer loop being joined to the inner loop at a first connection point disposed at the first attachment loop and at a second connection point disposed at the second attachment loop.

3. The quad anchor of claim 2, wherein the outer loop is joined to the inner loop at a plurality of third connection points disposed between the first pinch point and the second pinch point.

4. The quad anchor of claim 3, wherein the first loop is sewn to the second loop at at least one of the plurality of third connection points.

5. The quad anchor of claim 2, wherein the first connection point is located at a first end of the quad anchor and the second connection point is located at a second end of the quad anchor.

6. The quad anchor of claim 2, wherein the first loop and the second loop comprise at least one of: nylon; polyethylene; polyester; acrylic; aramid; or ultra-high molecular weight polyethylene.

7. The quad anchor of claim 2, wherein the first loop and the second loop are each 50 to 140 cm in length.

8. The quad anchor of claim 1, wherein at least one of the first pinch point and the second pinch point are sewn.

9. The quad anchor of claim 1, wherein the first pinch point is located 1-6 inches away from a first end of the first loop and the second pinch point is located 1-6 inches away from a second end of the first loop.

10. A quad anchor, comprising:

a first loop of flexible material;

a first attachment loop of flexible material, the first attachment loop being permanently joined to the first loop of flexible material at a first end of the first loop of flexible material;

a second attachment loop of flexible material, the second attachment loop being permanently joined to the first loop of flexible material at a second end of the first loop of flexible material, and a second loop of flexible material encircling the first loop of flexible material;

wherein the first loop of flexible material is configured to connect to a load between the first attachment loop and the second attachment loop.

11. The quad anchor of claim 10, wherein the second loop of flexible material is connected to the first loop of flexible material and the first attachment loop at the first end, and wherein the second loop of flexible material is connected to the first loop of flexible material and the second attachment loop at the second end.

12. The quad anchor of claim 10, further comprising a first spring hook configured to attach the first attachment loop to a first anchor point, a second spring hook configured to attach the second attachment loop to a second anchor point, and a third spring hook configured to attach to the first loop of flexible material between the first attachment loop and the second attachment loop to attach the load to the quad anchor.

13. The quad anchor of claim 1, wherein the first attachment loop, the second attachment loop, and the intermediate loop are comprised of a flexible material comprising a strength rating of at least 12 kN.

14. The quad anchor of claim 1, wherein the first attachment loop, the second attachment loop, and the intermediate loop are comprised of an elastic band, a woven rope, or a polymer strand.

* * * * *